US008385559B2

(12) United States Patent
Theverapperuma et al.

(10) Patent No.: US 8,385,559 B2
(45) Date of Patent: Feb. 26, 2013

(54) ADAPTIVE DIGITAL NOISE CANCELLER

(75) Inventors: Lalin Theverapperuma, St. Paul, MN (US); Talal Aly Youssef, Deephaven, MN (US)

(73) Assignee: Robert Bosch GmbH, Stuttgart (DE)

( * ) Notice: Subject to any disclaimer, the term of this patent is extended or adjusted under 35 U.S.C. 154(b) by 584 days.

(21) Appl. No.: 12/649,770

(22) Filed: Dec. 30, 2009

(65) Prior Publication Data

US 2011/0158419 A1 Jun. 30, 2011

(51) Int. Cl.
*G10K 11/16* (2006.01)

(52) U.S. Cl. ..... 381/71.6; 381/71.1; 381/71.11

(58) Field of Classification Search ..... 381/71.1–71.14, 381/71.6

See application file for complete search history.

(56) References Cited

U.S. PATENT DOCUMENTS

| | | | | |
|---|---|---|---|---|
| 4,644,581 | A | 2/1987 | Sapiejewski | |
| 4,677,676 | A | 6/1987 | Eriksson | |
| 4,677,677 | A | 6/1987 | Eriksson | |
| 4,987,598 | A | 1/1991 | Eriksson | |
| 5,182,774 | A | 1/1993 | Bourk | |
| 5,337,366 | A | 8/1994 | Eguchi et al. | |
| 5,384,853 | A | 1/1995 | Kinoshita et al. | |
| 5,546,467 | A | 8/1996 | Denenberg | |
| 5,602,929 | A * | 2/1997 | Popovich | 381/71.11 |
| 5,610,987 | A | 3/1997 | Harley | |
| 5,675,658 | A | 10/1997 | Brittain | |
| 5,699,436 | A | 12/1997 | Claybaugh et al. | |
| 5,815,582 | A * | 9/1998 | Claybaugh et al. | 381/71.6 |
| 5,940,519 | A | 8/1999 | Kuo | |
| 6,278,786 | B1 | 8/2001 | McIntosh | |
| 6,597,792 | B1 | 7/2003 | Sapiejewski et al. | |

(Continued)

FOREIGN PATENT DOCUMENTS

| | | |
|---|---|---|
| WO | 2008/006404 | 1/2008 |
| WO | 2008/051569 | 5/2008 |

(Continued)

OTHER PUBLICATIONS

Mackenzie et al. Low Order Modeling of Head-Related Transfer Functions using Balanced Model Truncation. IEEE Signal Processing Letters. Feb. 1997. vol. 4, No. 2.*

(Continued)

*Primary Examiner* — Disler Paul

(74) *Attorney, Agent, or Firm* — Michael Best & Friedrich LLP

(57) ABSTRACT

Systems and methods for adaptive feed-forward noise cancellation. The system includes a plurality of reference microphones, an error microphone, a secondary path module, an adaptation controller, and a canceller filter. A finite impulse response ("FIR") based plant model is converted to an infinite impulse response ("IIR") based plant model using balanced model reduction. Due to the inherent instability of the adaptive IIR filter, the Schur-Cohn stability test is applied to the denominator coefficients of the IIR filter transfer function to determine the stability of the noise cancellation system. A secondary path of the noise cancellation system is identified in an on-line manner in the secondary path module. If the energy level of the communication signal (e.g., a music signal) is strong, secondary path identification is performed. The adaptation controller controls the updating of the IIR transfer function based on the stability determination and the secondary path. An anti-noise signal is then generated and added to the communication signal. The anti-noise signal is generated within approximately 60 or fewer micro-seconds.

18 Claims, 8 Drawing Sheets

U.S. PATENT DOCUMENTS

| | | | | |
|---|---|---|---|---|
| 6,628,788 | B2 | 9/2003 | Azizi | |
| 6,741,707 | B2 | 5/2004 | Ray et al. | |
| 6,847,721 | B2 | 1/2005 | Zhang et al. | |
| 6,996,241 | B2 | 2/2006 | Ray et al. | |
| 7,020,279 | B2 | 3/2006 | Usman et al. | |
| 7,343,016 | B2 | 3/2008 | Kim | |
| 2005/0207585 | A1 | 9/2005 | Christoph | |
| 2005/0249355 | A1 | 11/2005 | Chen et al. | |
| 2005/0276421 | A1 | 12/2005 | Bergeron et al. | |
| 2006/0013408 | A1 | 1/2006 | Lee | |
| 2008/0095389 | A1 | 4/2008 | Theverapperuma | |
| 2008/0112569 | A1 | 5/2008 | Asada | |
| 2008/0181422 | A1 | 7/2008 | Christoph | |
| 2008/0310645 | A1 | 12/2008 | Itabashi et al. | |
| 2009/0041260 | A1 | 2/2009 | Jorgensen et al. | |
| 2009/0080670 | A1 | 3/2009 | Solbeck et al. | |
| 2011/0007907 | A1 * | 1/2011 | Park et al. | 381/71.8 |

FOREIGN PATENT DOCUMENTS

| | | | |
|---|---|---|---|
| WO | 2008/051570 | | 5/2008 |
| WO | WO 2008051569 | A2 * | 5/2008 |
| WO | 2009/007245 | | 1/2009 |
| WO | 2009/081184 | | 7/2009 |

OTHER PUBLICATIONS

PCT/US2010/062472 International Search Report and Written Opinion dated Apr. 26, 2012 (15 pages).

Beliczynski et al., "Approximation of FIR by IIR Digital Filters: An Algorithm Based on Balanced Model Reduction," IEEE Transactions on Signal Processing, Mar. 1, 1992, vol. 40, No. 3, pp. 532-541.

Kale et al., "Motor car acoustic response modelling and order reduction via balanced model truncation," Electronics Letters, May 23, 1996, vol. 32, No. 11, pp. 965-966.

MacKenzie et al., "Low-Order Modeling of Head-Related Transfer Functions Using Balanced Model Truncation," IEEE Signal Processing Letters, Feb. 1, 1997, vol. 4, No. 2, pp. 39-41.

O'Brien et al., "H/spl infin/ Active Noise Control of Fan Noise in an Acoustic Duct," American Control Conference, Jun. 28, 2000, vol. 5, pp. 3028-3032.

Kuo, Sen, M., et al., "Active Noise Control: A Tutorial Review", Proceedings of the IEEE, vol. 87, No. 6, pp. 943-973, Jun. 1999.

"Model Reduction", Massachusetts Institute of Technology Department of Electrical Engineering and Computer Science, 6.242, Fall 2004.

Pasquato, Lorenzo, et al., "Adaptive IIR Filter Initialization via Hybrid FIR/IIR Adaptive Filter Combination", IEEE Transactions on Instrumentation and Measurement, vol. 50, No. 6, pp. 1830-1835, Dec. 2001.

Phan, Minh, Q., et al, "A Direct Method for State-Space Model and Observer/Kalman Filter Gain Identification", AIAA Guidance, Navigation, and Control Conference and Exhibit, Providence, Rhode Island, American Institute of Aeronautics and Astronautics, AIAA 2004-5414, Aug. 16-19, 2004.

Kale, I., et al., "FIR Filter Order Reduction: Balanced Model Truncation and Hankel-Norm Optimal Approximation", IEE Proc.-Vis. Image Signal Process, vol. 141, No. 3, pp. 168-174, Jun. 1994.

Landon IP Inc., Patent Search Report, pp. 9-11, search conducted through Oct. 8, 2009.

Elliott, S.J., et al., "The Active Control of Sound", Electronics & Communication Engineering Journal, pp. 127-136, Aug. 1990.

Boucher, C.C., "Effect of Errors in the Plant Model on the Performance of Algorithms for Adaptive Feedforward Control", IEE Proceedings-F, vol. 138, No. 4, pp. 313-319, Aug. 1991.

Tahir Akhtar, Muhammad, et al., "On Active Noise Control Systems with Online Acoustic Feedback Path Modeling", IEEE Transactions on Audio, Speech, and Language Processing, vol. 15, No. 2, pp. 593-600, Feb. 2007.

Avessta, Nastooh, et al., "Combined Regressor Methods and Adaptive IIR Filtering", IEEE Transactions on Circuits and Systems-I: Regular Papers, vol. 51, No. 11, pp. 2222-2234, Nov. 2004.

Safonov, M.G., et al., "A Schur Method for Balanced-Truncation Model Reduction", Technical Notes and Correspondence, IEEE Transactions on Automatic Control, vol. 34, No. 7, pp. 729-733, Jul. 1989.

Datta, Biswa, "Numerical Methods for Linear Control Systems", Chapter 14—Internal Balancing and Model Reduction, Academic Press, 2003.

* cited by examiner

ADAPTIVE DIGITAL NOISE CANCELLER

BACKGROUND

This invention relates to noise cancelling headsets (e.g., headphones, ear buds, etc.).

Noise cancellation headsets are used in, among other places, high-noise environments such as aircraft cockpits or in the vicinity of loud machines. A variety of techniques have been developed to provide noise cancellation in headsets. For example, many conventional noise cancellers use analog noise cancellation, and use either feedback or feed-forward control techniques. Feedback noise cancellation is commonly used in headsets with large acoustic cavities. Feed-forward noise cancellation is commonly used in ear buds and on-ear headsets.

Feed-forward noise cancellers cancel unwanted ambient noise signals arriving at a wearer's ear using the principle of superposition. For example, feed-forward noise cancellers generate anti-noise signals using a canceller filter that is based on a plant model (e.g., a transfer function) for the headset. Particularly, the cancellers create anti-noise signals which are equal or approximately equal in magnitude, and opposite in phase (i.e., approximately 180° out of phase), to cancel the unwanted noise signals. This is achieved using a reference microphone. The reference microphone is placed on the outside or periphery of a headset, and senses incoming unwanted noise signals. The sensed noise signals are processed and, using the plant model, the anti-noise signal is generated.

Conventionally, the plant is determined using empirical methods. In order for the analog noise canceller to provide optimal performance, the canceller filter must be finely tuned to match the dynamics of the actual headset. This is achieved, for example, by changing or updating parameters of the canceller filter while monitoring its performance. However, in order to correctly generate anti-noise signals, the noise canceller must be able to accurately identify noise signals at the wearer's ear while the headset is being worn. A loudspeaker is then used to drive both the normal audio signals and the anti-noise signals.

An example of an analog feed-forward noise canceller system is shown in FIG. 1. The system 10 includes a reference microphone 15, a speaker 20, and a feed-forward controller 25. An audio signal, x(t), is a signal from an audio device, and an acoustic signal, y(t), is a signal at the wearer's ear. The headset plant model is determined from d(t) and y(t). However, a secondary path also exists which affects noise cancellation. An example of a feed-forward system 30 which includes an error microphone 35, a secondary path model 40, an adaptation module 45, and a canceller filter 50 is illustrated in FIG. 2. When the error microphone 35 is used, the plant model refers to a transfer function between the reference microphone 15 and the error microphone 35, and the secondary path generally refers to the path between the speaker 20 and the error microphone 35. Accurate identification of the secondary path's transfer function is necessary to correctly update the canceller filter.

SUMMARY

Using the above-described techniques, the plant model is based on test systems and empirical analysis, not an actual system plant. As such, changes to the system plant are ignored. For a canceller filter to perform well (i.e., to generate a precise anti-noise signal), the canceller filter must match the combined acoustics of the headset and wearer, which may vary greatly from an empirical model and cannot typically be generalized with a single unified plant model. The anti-noise signal generated using the canceller filter must be adapted as the acoustic path changes. For example, the acoustic path between an ear-cup of a headset and the wearer's head changes based on, among other things, the position of the headset on a wearer, the sealing of the ear-cups, the wearer's head size, barometric pressure, temperature, and manufacturing variations. These factors can cause the canceller filter to perform poorly in various situations. Using a single plant model does not take these factors into consideration, and the canceller filter performs poorly as a result. Additionally, the canceller filter must adapt as the arrival direction of the unwanted noise signals changes, because the anti-noise signals needed to properly cancel the unwanted noise signals change as the direction of the unwanted noise signals change. Fixed filters are unable to adapt to such changes.

Embodiments of the invention provide techniques for implementing a digital feed-forward noise cancellation system and method using an adaptive infinite impulse response ("IIR") filter as the canceller filter. The canceller filter is constantly updated or adapted to account for changes to the system and actual plant. Such a canceller filter is able to adapt to both changes in the actual plant and changes in the arrival direction of the unwanted noise signals. The IIR filter reduces the latency of the system when compared to a traditional finite impulse response ("FIR") filter. An FIR filter requires hundreds of taps and is not practical in low latency applications (e.g., headsets).

In one embodiment, the invention provides a system that includes three or more reference microphones, an error microphone, a secondary path module, an adaptation controller, and a canceller filter. An FIR plant model is converted to an IIR plant (i.e., an adaptive IIR filter) using balanced model reduction. Due to the inherent instability of the adaptive IIR filter, the Schur-Cohn stability test is applied to the denominator coefficients of the IIR filter's transfer function to validate the stability of the noise cancellation system before the denominator coefficients are updated. If a disturbance is identified that may compromise the stability of the system, adaptation of the denominator of the IIR filter's transfer function is slowed or stopped to maintain stability. The secondary path of the noise cancellation system is identified in an on-line manner. If the energy level of the communication signal (e.g., a music signal) approximates a white noise signal, secondary path identification is performed. The anti-noise signal is then generated and added to the communication signal. The anti-noise signal is generated within approximately sixty or fewer micro-seconds.

In another embodiment, the invention provides an adaptive noise cancellation system for a headset. The noise cancellation system includes a plurality of reference microphones, an error microphone, and a controller. The reference microphones are configured to detect a noise signal, and the error microphone is configured to detect an acoustic error signal. The controller is connected to the plurality of reference microphones and the error microphone. The controller is configured to control the adaptation of an IIR canceller filter based at least in part on a stability determination for the noise cancellation system and a secondary path model. The controller is also configured to control the updating of the secondary path model, generate an anti-noise signal based on the canceller filter, and output the anti-noise signal. The IIR canceller filter is generated as a balanced model reduction of an FIR canceller filter, and the anti-noise signal is electrically combined with an audio signal to generate a combined signal. The combined signal is provided to an output speaker.

In another embodiment, the invention provides a method of implementing adaptive noise cancellation in a system which includes a plurality of reference microphones and an error microphone. The method includes detecting one or more noise signals using the plurality of reference microphones, detecting an acoustic error signal using the error microphone, identifying a secondary path model in an on-line manner, and determining a stability of the system. The method also includes controlling adaptation of an IIR canceller filter based at least in part on the stability determination and the identified secondary path model, generating an anti-noise signal based on the canceller filter, outputting the anti-noise signal, and electrically combining the anti-noise signal with an audio signal to generate a combined signal. The IIR canceller filter is a reduction of an FIR canceller filter.

In yet another embodiment, the invention provides a controller configured to generate an anti-noise signal. The controller includes a memory module and a processing unit. The processing unit is configured to receive a reference signal related to a first acoustic signal detected by a reference microphone, receive an error signal related to a second acoustic signal detected by an error microphone, identify a secondary path model in an on-line manner, and determine a stability of the system. The processing unit is also configured to control adaptation of an IIR canceller filter based at least in part on the stability determination and the identified secondary path model, and generate the anti-noise signal based on the canceller filter. The IIR canceller filter is a reduction of an FIR canceller filter.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Embodiments of the invention described herein relate to an adaptive feed-forward noise cancellation system for a headset which is used in, for example, aircraft cockpits or other high-noise environments. The system includes three or more reference microphones, a controller, and an error microphone. The controller includes a secondary path model module, an adaptation controller, and a canceller filter. For the noise cancellation system to function properly, an anti-noise signal must be generated in less time than is required for sound (e.g., a noise signal) to travel from at least one of the reference microphones to the error microphone. If the anti-noise signal is not generated in sufficient time, the noise cancellation system is unable to properly cancel the noise signal. For example, a headset having an ear cup thickness of approximately 20 mm requires the anti-noise signal to be generated in less than approximately 40 microseconds ("μs"). A finite impulse response ("FIR") filter, which is traditionally used in noise cancellation systems, is unable to meet the inflexible latency requirements of an adaptive feed-forward noise cancellation system. To meet these latency requirements, an FIR-filter-based plant model is converted to an infinite impulse response ("IIR") based plant model using balanced model reduction.

Due to the inherent instability of the IIR filter, the Schur-Cohn stability test is applied to the denominator coefficients of the IIR filter's transfer function to validate the stability of the noise cancellation system before the transfer function's denominator coefficients are updated. If a disturbance is identified that is capable of compromising the stability of the system, adaptation of the IIR filter is slowed or stopped to maintain stability. A secondary path is updated in an on-line manner (described in greater detail below), and no artificial white noise signals need to be inserted into the output of the speaker. Instead, a communication signal is used to identify the secondary path. If the energy level of the communication signal (e.g., a music signal) is strong and approximates white noise, secondary path updating is performed. (The secondary path generally refers to the path between the output speaker and the error microphone.) The anti-noise signal is then generated and electrically added to the communication signal. Such a digital, adaptive-feed-forward noise cancellation system has low latency and improves noise cancellation.

Figure 1:
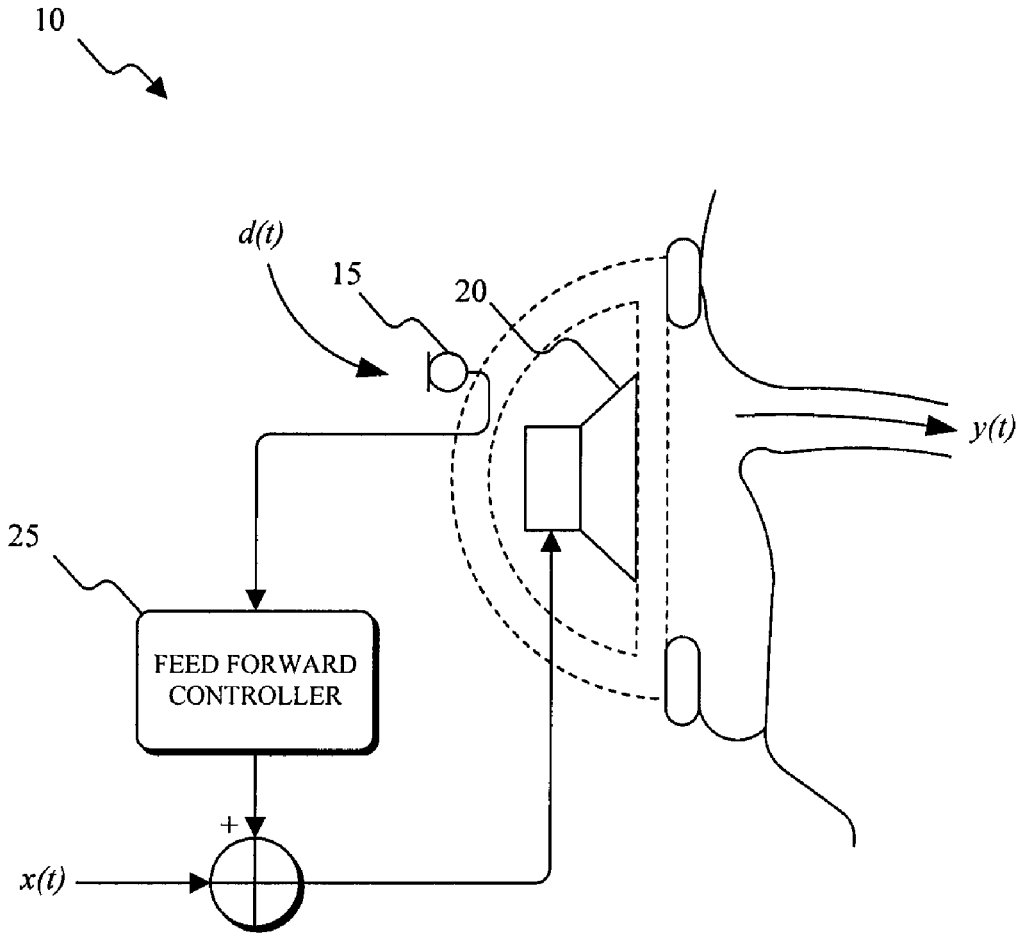
FIG. 1 (Prior Art)
FIG. 1 illustrates an analog feed-forward noise cancellation system.
Figure 2:
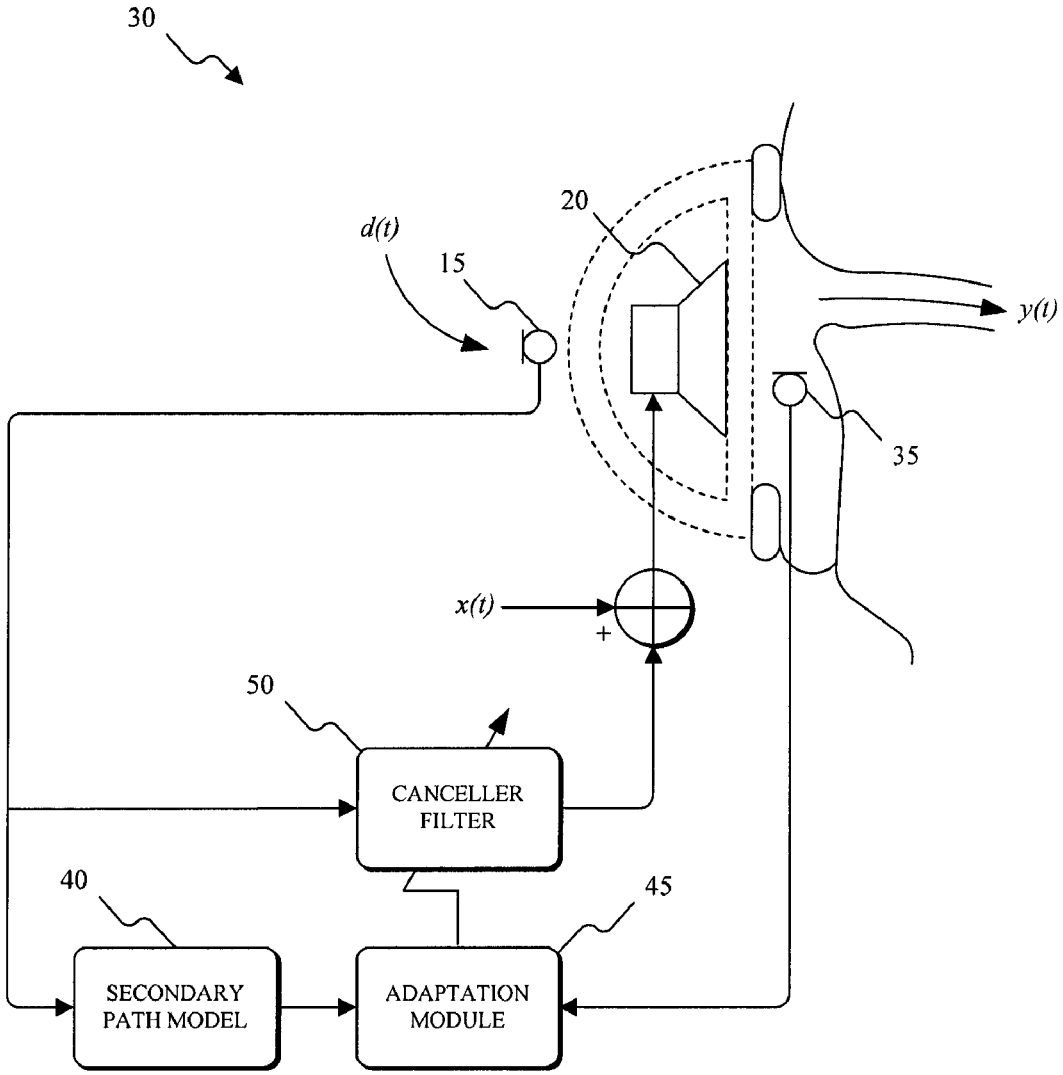
FIG. 2 (Prior Art)
FIG. 2 illustrates an adaptive feed-forward noise cancellation system.
Figure 3:
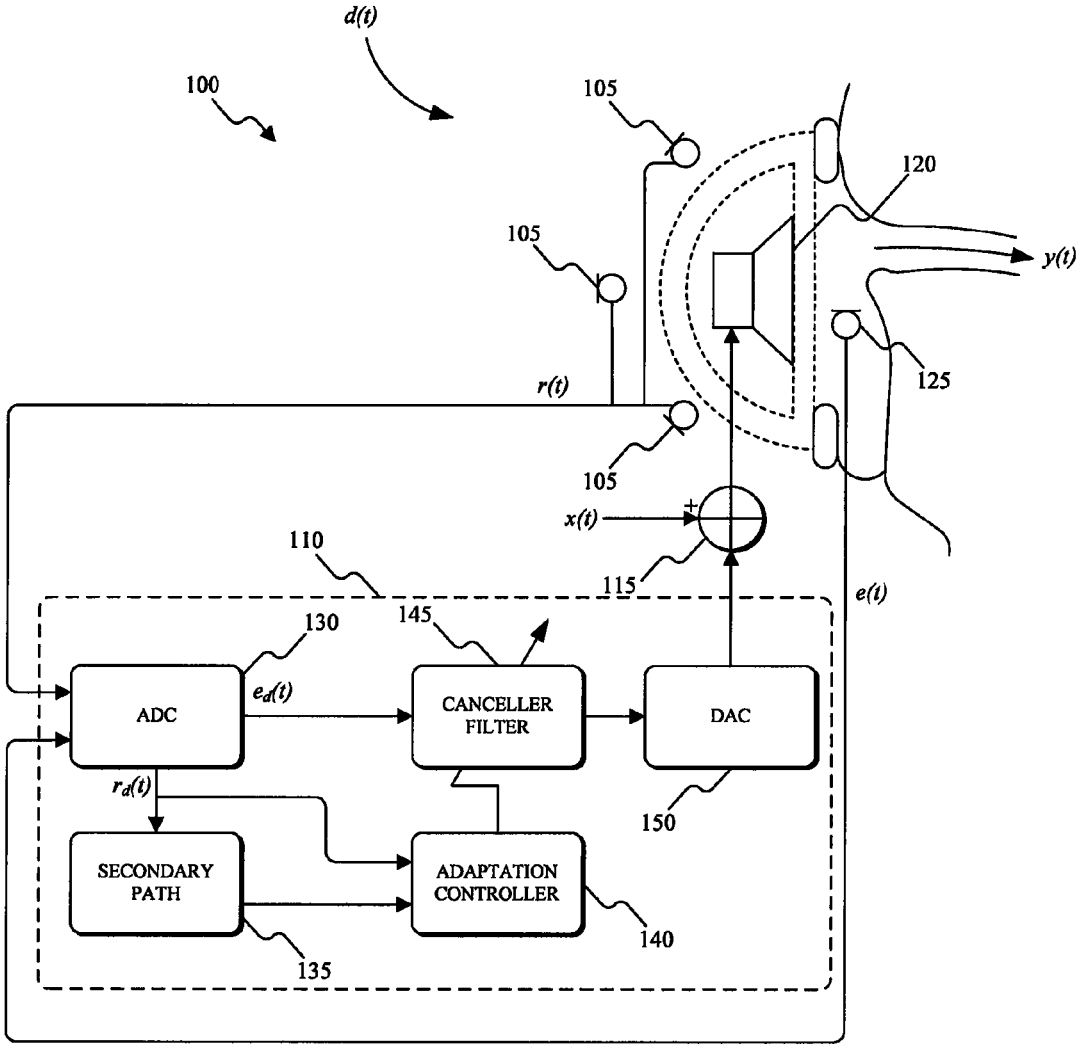
FIG. 3 illustrates a digital adaptive feed-forward noise cancellation system according to an embodiment of the invention.

An embodiment of a digital, adaptive-feed-forward noise cancellation system 100 as described above is illustrated in FIG. 3. The system 100 includes a plurality of reference microphones 105, a controller (e.g., a digital signal processor ("DSP")) 110, a summation module 115, a speaker 120, and an error microphone 125. The controller 110 includes, among other things, an analog-to-digital converter ("ADC") 130, a secondary path module 135, an adaptation controller module 140, a canceller filter module 145, and a digital-to-analog converter ("DAC") module 150. The controller 110 also includes a processing unit such as a microprocessor, a microcontroller, or the like, and the processing unit is connected to a memory module and an input/output module via one or more busses. The memory module may include, for example, various electronic memory devices such as read-only memory ("ROM"), random access memory ("RAM"), electrically-erasable programmable read-only memory ("EEPROM"), flash memory, or another suitable non-transitory storage medium. The input/output module transfers information between components within the controller 110 and other components of the noise cancellation system 100. The controller 110 is also configured to communicate with other components or subsystems within the noise cancellation system 100 using the busses or a communication interface. Software included in the implementation of the controller 110 is stored in the memory module. The software includes, for example, firmware, one or more applications, program data, one or more program modules, and other executable instructions. The controller 110 is configured to retrieve from memory and execute, among other things, the control processes and methods described below. In other embodiments, the controller 110 includes additional, fewer, or different components.

Generating an anti-noise signal that adequately cancels a noise signal detected by the reference microphones 105 is dependent upon properly identifying a plant model for the system or headset. The plant model is generally measured from the reference microphone 105 to the error microphone 125. The passive acoustics of the headset have a significant impact on the plant model. For example, the passive acoustics of the headset are affected by manufacturing variations, wear and tear from normal use, and environmental variations (e.g., changes in temperature). Additionally, the plant model varies with the type of headset (e.g., ear buds, over-the-ear headphones, etc). The type of headset primarily changes the plant model based on the placement of the headset on a user's head, the user's ear shape, and the positioning of the headset.

The plant model is generally modeled using linear time-invariant, digital-filter transfer functions, and is identified by exciting the system with white noise and analyzing an impulse response. For example, the distance between the reference microphone 105 and the error microphone 125 is approximately 20 mm. Although the direct acoustic path is traversed in less than a hundred microseconds, the impulse response of this acoustic plant model can range from 2-4 milliseconds ("ms"). The duration of the impulse response is due primarily to the complex acoustic environment that is created by reflections and absorptions of sound near the user's ear.

Implementing a plant model using an FIR filter requires the FIR filter to be, in many instances, several hundred taps long (e.g., 160-260 taps long). As previously described, in order to effectively cancel a noise signal, the generated anti-noise signal must arrive at the user's ear as the noise signal is arriving. Also, for good resolution, a sampling rate of one sample every 30 μs or faster is required, and canceller filter taps must be close enough to capture the details of the canceller filter transfer function. However, due to the length of the FIR filter, convolving the FIR filter with a reference signal causes delays which prevent the anti-noise signal from being generated in sufficient time to cancel the noise signal. For example, in order to convolve a 250 tap filter, 250 multiplications/accumulates ("MACs") are needed. Such a lengthy filter converges very slowly. Also, each of the 250 filter taps needs to be updated which requires another 250 MACs, for a total of 500 MACs. Using current DSPs, these calculations would require approximately 150-250 μs. The inability of FIR based systems to generate the anti-noise signal in sufficient time limits the applicability and effectiveness of digital noise cancellation systems. If fact, such systems only provide adequate noise cancellation in systems which allow for significantly longer acoustic delays (e.g., HVAC ducts).

Accordingly, an FIR filter cannot be used in the canceller filter module 145. Instead, an original, FIR-filter-based plant model is converted to an IIR-filter-based plant model using, for example, balanced model reduction. Such an IIR filter reduces the filter size from, for example, 250 taps to approximately 14 taps, which requires only 28 MACs. In general, the goal of reducing the model size is to remove the modes of a system that cannot be controlled or observed (i.e., are insignificant). In a balanced realization of the system, modes of the system which are controllable or observable (i.e., significant) are clearly seen. Balanced model reduction is accomplished using any of a variety of techniques, such as balanced model truncation ("BMT"), Shur model reduction ("SMR"), and Hankel-norm model reduction ("HMR").

Although a variety of balanced model reduction techniques can be used, BMT is the technique used in the examples provided below. Using BMT simplifies computations because the initial system is based on an FIR plant model. However, using a model reduction technique, such as BMT, also has adverse effects on the controllability and operation of the noise cancellation system, primarily due to the instability of IIR filters. The effects of this instability must be compensated in order to properly implement an adaptive feed-forward noise cancellation system using an IIR canceller filter. Following the below description of the conversion of the FIR-filter-based plant model to the IIR-filter-based plant model are descriptions of features of the invention which are used to implement a practical digital noise cancellation system.

The first step in converting an FIR-filter-based plant model to an IIR-filter-based plant model is to write a plant transfer function, F(z), as a set of state-space equations. For example, the plant transfer function, F(z), for an ear-cup is shown below in EQN. 1.

$$Y(z)=D(z)F(z) \qquad \text{EQN. 1}$$

where D(z) and Y(z) are z-transformed noise and anti-noise signals, respectively.

The impulse response model of the plant transfer function, F(z), is shown below in EQN. 2.

$$F(z)=c_0+c_0z^{-1}+c_0z^{-2}+\ldots+c_0z^{-n}$$

$$=C(zI-A)^{-1}B+D \qquad \text{EQN. 2}$$

where $c_i$ is the $i^{th}$ coefficient of the impulse response, $z^{-1}$ is a unit delay, and $D=c_0$.

The plant transfer function, F(z), of order n, is then written as a state-space difference equation, as shown below in EQNS. 3 and 4.

$$x(k+1) = Ax(k) + Bd(k) \qquad \text{EQN. 3}$$

$$y(k) = Cx(k) + Dd(k) \qquad \text{EQN. 4}$$

where $$A = \begin{bmatrix} 0 & 0 & 0 & \ldots & 0 \\ 1 & 0 & 0 & \ldots & \\ 0 & 1 & 0 & \ldots & \\ \ldots & \ldots & \ldots & \ldots & \\ 0 & 0 & & 1 & 0 \end{bmatrix}$$

$$B = \begin{bmatrix} 1 \\ 0 \\ \ldots \\ \ldots \\ 0 \end{bmatrix}$$

$$C = [\, c_1 \quad c_2 \quad c_3 \quad \ldots \quad c_n \,]$$

and $$D = c_0$$

Input signals, d(k) and x(k), are the signals from the reference microphone 105 and the internal state of the system at sample k, respectively. This is one of an infinite number of possible state space realizations which are able to represent the plant transfer function, F(z). For example, similarity transforms are used to transform the state-space realization above to another realization. However, only one transform permits the plant transfer function to be transformed into a balanced realization.

Two matrices, P and Q, are defined for the state space realization (A, B, C, D) of the system described above. The matrices are solutions to the Lyapunov equations, and are given by EQNS. 5 and 6 below.

$$P=APA^T+BB^T \quad \text{EQN. 5}$$

$$Q=AQA^T+C^TC \quad \text{EQN. 6}$$

The matrices, P and Q, are known as the controllability and observability grammians. When the system is stable, controllable, and observable, EQNS. 5 and 6 have solutions. The matrices, P and Q, are not unique and are dependent upon the state space realization. However, their product eigenvalues, $\lambda_i(PQ)$, are independent of the state space realization, and depend only on the plant transfer function, F(z).

By choosing the similarity transform, T, as $$T=S^{-1}U\Sigma^{1/2} \quad \text{EQN. 7}$$

where $$Q=S^TS \quad \text{EQN. 8}$$

$$UU^T=I \quad \text{EQN. 9}$$

and I is a unit matrix, the state space realization can be transformed to the balanced realization given below in EQN. 10.

$$P=Q=\Sigma=\text{diag}\{\sigma_1,\sigma_2,\sigma_3,\ldots,\sigma_n\} \quad \text{EQN. 10}$$

where $\Sigma$ is a Hankel singular value matrix, and $\sigma_i$ are the Hankel singular values. EQN. 11 is then true for the above system.

$$\sigma_i(F(z))=\{\lambda_i(PQ)\}^{1/2} \quad \text{EQN. 11}$$

Following transformation into a balanced realization, the system is decomposed into significant (i.e., dominant) and insignificant portions. For descriptive purposes, assume that $(A_b, B_b, C_b)$ is a balanced system. The Hankel singular value matrix, $\Sigma$, is decomposed into two parts, $\Sigma_1$ and $\Sigma_2$, as shown below in EQN. 12.

$$\Sigma=\begin{bmatrix}\Sigma_1 & 0\\ 0 & \Sigma_2\end{bmatrix} \quad \text{EQN. 12}$$

where $$\Sigma_1=\text{diag}\{\sigma_1,\sigma_2,\ldots\sigma_k\} \quad \text{EQN. 13}$$

and $$\Sigma_2=\text{diag}\{\sigma_{k+1},\sigma_{k+2},\ldots\sigma_n\} \quad \text{EQN. 14}$$

Following portioning, the state space matrices are written as $$A_b=\begin{bmatrix}A_{11} & A_{12}\\ A_{21} & A_{22}\end{bmatrix}$$

$$B_b=\begin{bmatrix}B_1\\ B_2\end{bmatrix}$$

$$C_b=[\,C_1 \quad C_2\,]$$

Additionally, the truncated system is written as $$(A_{11},B_1,C_1)$$

and the rejected system is written as $$(A_{22},B_2,C_2)$$

If the system $(A_b, B_b, C_b)$ is asymptotically stable and balanced, then the truncated system, $(A_{11}, B_1, C_1)$, and the rejected system, $(A_{22}, B_2, C_2)$, are also balanced and stable.

A model size parameter, k, for reducing the size of the plant model is selected based on the spread of the Hankel eigenvalues. For example, in one embodiment, one third of the mean eigenvalues are selected, although other criteria for reducing the plant model size can also be used. Excessive reduction in plant model size reduces the effectiveness of the plant model and degrades the performance of the canceller filter.

The truncated model, $(A_{11}, B_1, C_1)$, is transformed back into a plant transfer function using EQN. 15 below.

$$H(z)=C_1(zI-A_{11})^{-1}B_1+D \quad \text{EQN. 15}$$

which is a $k^{th}$ order IIR-filter-based plant model for use in the noise cancellation system 100. The model reduction process described above has an effect that is similar (nearly equivalent) to adding observable or controllable modes to the plant model.

Figure 4:
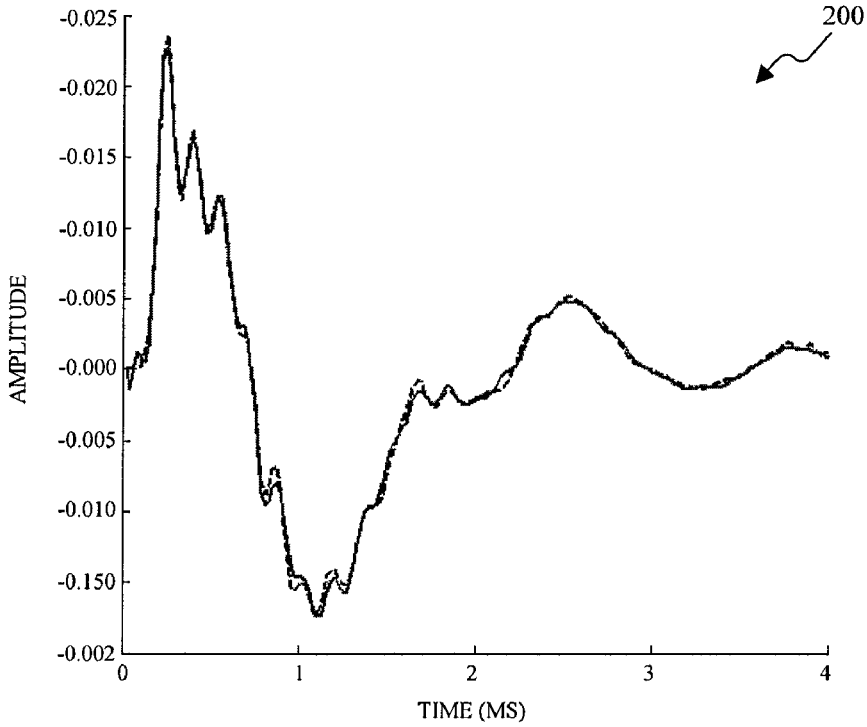
FIG. 4 illustrates an impulse response of a finite impulse response ("FIR") based plant model and a reduced-order infinite impulse response ("IIR") based plant model.
Figure 5:
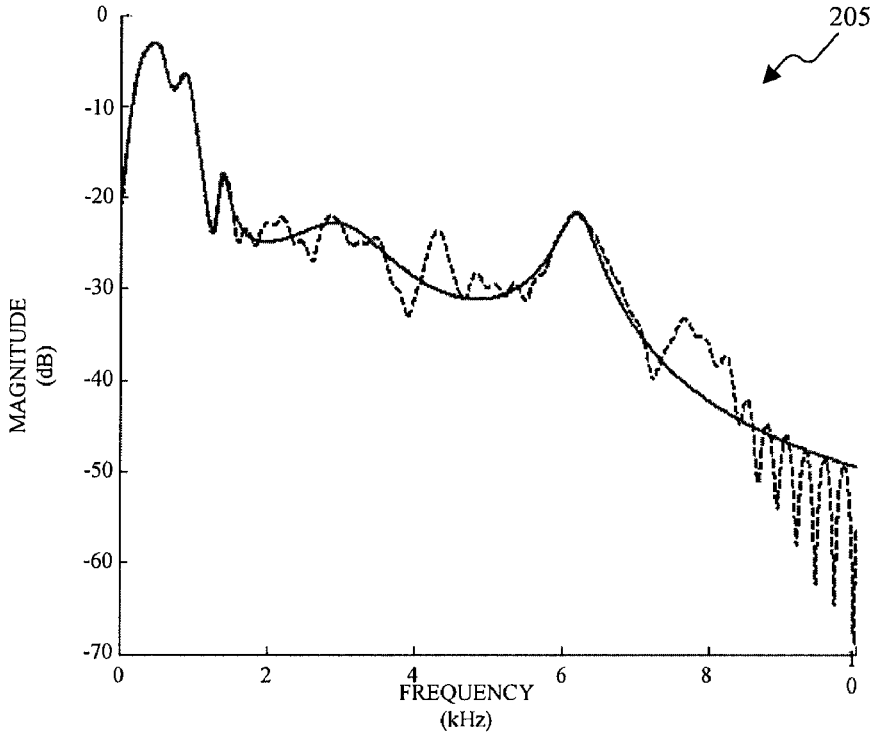
FIG. 5 illustrates a magnitude response of the FIR based plant model and the reduced-order IIR based plant model.

A comparison 200 of the FIR-filter-based plant model and the IIR-filter-based plant model with respect the impulse response of each model is shown in FIG. 4. The impulse response of an FIR-filter-based plant model having 192 taps and an IIR-filter-based plant model having 14 taps (i.e., 14 eigen modes) were recorded at a resolution of 20 μs. As the order of the IIR based plant model was reduced, plant models having between approximately 12 and 18 eigen modes exhibited comparable model error values to the FIR-filter-based plant model having 192 taps. Higher order modeling of the IIR based plant model did not necessarily result in a smaller model error. As such, including additional observable and controllable modes yields only marginal improvements in model error of the IIR-filter-based plant model. Also, in order to successfully generate an anti-noise signal, the phase of the IIR-filter-based plant model must approximately match the phase of the FIR-filter-based plant model. The correlation between the impulse responses of the FIR and IIR-filter-based plant models shown in FIG. 4 confirms the correlation between the respective phases of the FIR and IIR based plant models. The correlation between the two plant models is further illustrated by the magnitude frequency responses of the FIR-filter-based plant model and the IIR-filter-based plant model shown in FIG. 5.

As previously described, one of the primary obstacles to using IIR filters for noise cancellation is stability. Stabilization of the IIR-filter-based plant model during updating (i.e., adaptation) is accomplished using, for example, minimum mean square criteria with pole stabilization in the adaptation controller module 140 to maintain the stability of the system. Such a technique causes the denominator coefficients of IIR filter to change slowly or not at all, depending on the stability of the system. In one embodiment, each time a change request for the denominator coefficients is identified, the denominator coefficient change request is logged in a memory of the system. A coefficient change is confirmed when the same denominator coefficient change request is logged for a predetermined number of cycles or a predetermined amount of time. Schur-Cohn stability tests and criteria are used to confirm the stability of the system and grant a denominator change request. For example, when a change has occurred to the system which requires an update to the denominator coefficients of the canceller filter to minimize a model error and the need for this update persists, the denominator coefficients are updated following a confirmation of stability. Updating of the denominator coefficients is also decimated to reduce the frequency of the update. By reducing the frequency of denominator updates, processing resources are conserved, and the update can be performed in a background processing thread.

In some embodiments, the adaptation controller module 140 determines the poles of the denominator and determines whether they indicate that the system is unstable. Additionally or alternatively, the adaptation controller module 140 determines or estimates future pole positions to determine whether the system is heading toward an unstable state. Based on the position of poles with respect to a predefined or determined threshold value (e.g., the unit circle), stability of the system is determined. In some embodiments, a second threshold value, which represents a more stable pole position than the first threshold value, is included to maintain a stricter control of stability. In such embodiments, updating of the denominator coefficients only occurs when the poles are within the first or second threshold values. In other embodiments, updating of the denominator coefficients is completely stopped or prevented. In such embodiments, the denominator coefficients are locked at predetermined values, or are locked at values determined at the initialization of the system.

In addition to the proper identification of the passive acoustics of a headset, the secondary path of the system must also be correctly identified to ensure proper convergence of the canceller filter. The secondary path of the system is identified using an on-line modeling technique in the secondary path module 135. The secondary path module 135 receives the analog-to-digital converted signal from the reference microphones 105, and outputs a signal corresponding to the acoustic signal between the speaker 120 and the error microphone 125. The output of the secondary path module 135 affects both the numerator and denominator of the canceller filter transfer function in the canceller filter module 145, but as previously described, the denominator is only updated when stability is confirmed. Because the secondary path is updated in an on-line manner, it is updated based on a communication signal (e.g., a music signal, a signal from a mouthpiece, etc.). When the communication signal is uncorrelated (i.e., approximates a white noise signal) and is larger than a threshold value, the communication signal is used to identify the secondary path. For example, a linear predictive error module is used to identify the correlated component of the communication signal, and control the secondary path updates or adaptations based on the level of correlation in the communication signal. A first advantage of such a technique is that secondary path identification is fast when the communication signal is highly uncorrelated or approximately white noise. A second advantage is that that the secondary path identification filters converge to the secondary path model without a bias solution. A bias solution results from, for example, a highly correlated communication signal being used to identify the secondary path instead of an approximately white noise signal. A third advantage is that such techniques, when accompanied by ambient noise monitoring, allow for the validation of the secondary path without any artifacts (e.g., injected white noise signals).

To adequately monitor the ambient noise, placement of the reference microphones 105 on the ear-cup is critical. As previously described, conventional headsets include a single reference microphone. By including additional reference microphones (i.e., more than one reference microphone), the plant model is able to be updated based on the directionality of the ambient noise signals. In one embodiment, three reference microphones are equidistantly spaced around the exterior of an ear cup. Each reference microphone yields a different transfer function for ambient noise originating from a different direction. As such, the reference microphone which has the greatest effect on the plant model (i.e., provides the signal having the greatest magnitude), is selected to update the canceller filter. In other embodiments, superposition is used to generate a combined transfer function based on each of the reference microphones, or the signals from each of the reference microphones are combined and averaged. The combined transfer function changes over time based on the relative contributions of the transfer functions associated with each of the reference microphones 105 and on the incident direction of the ambient noise. As such the anti-noise signal is generated based at least in part on the incident direction of the ambient noise.

Figure 6:
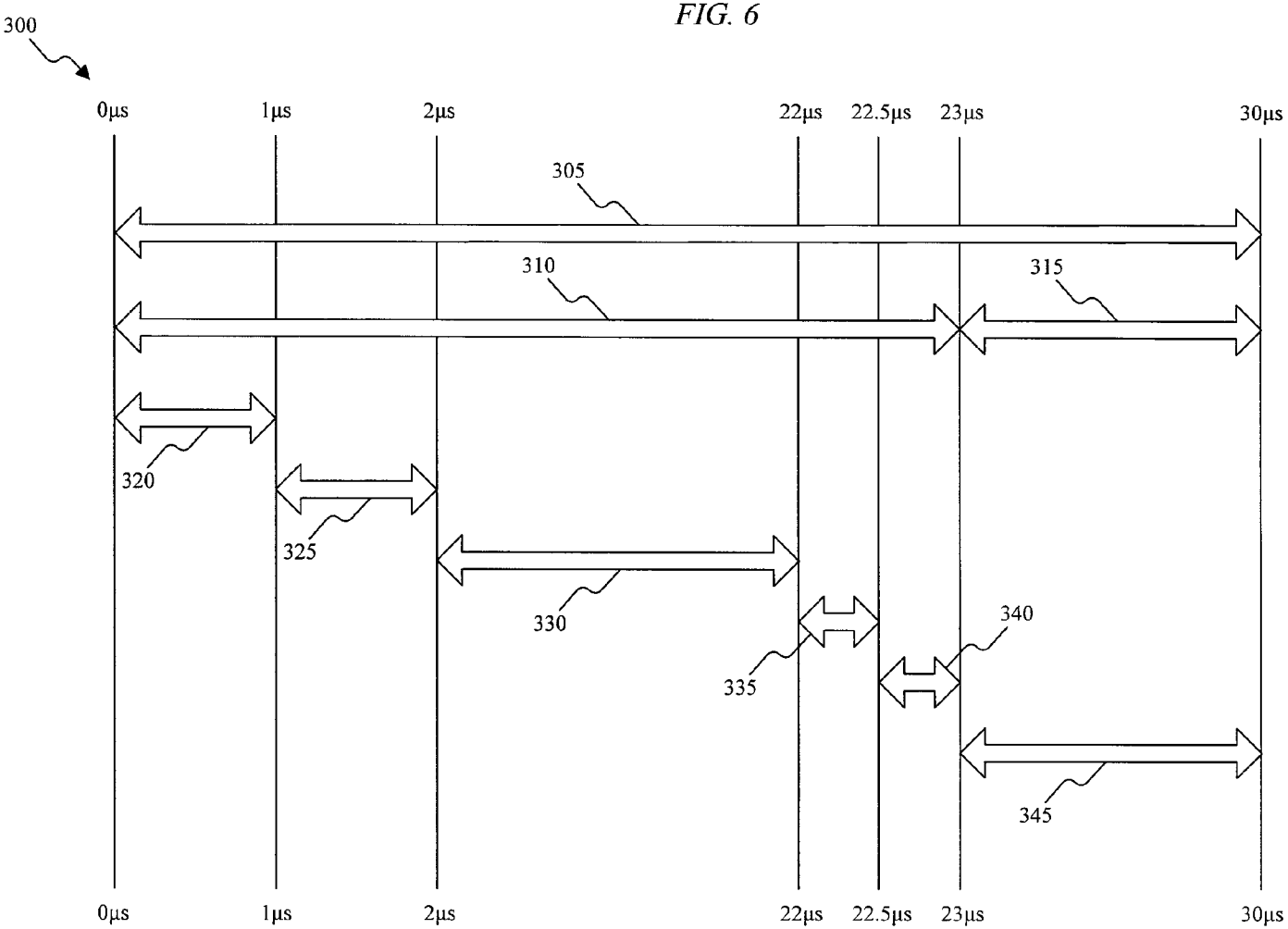
FIG. 6 illustrates a timing diagram for the noise cancellation system of FIG. 3.
Figure 7:
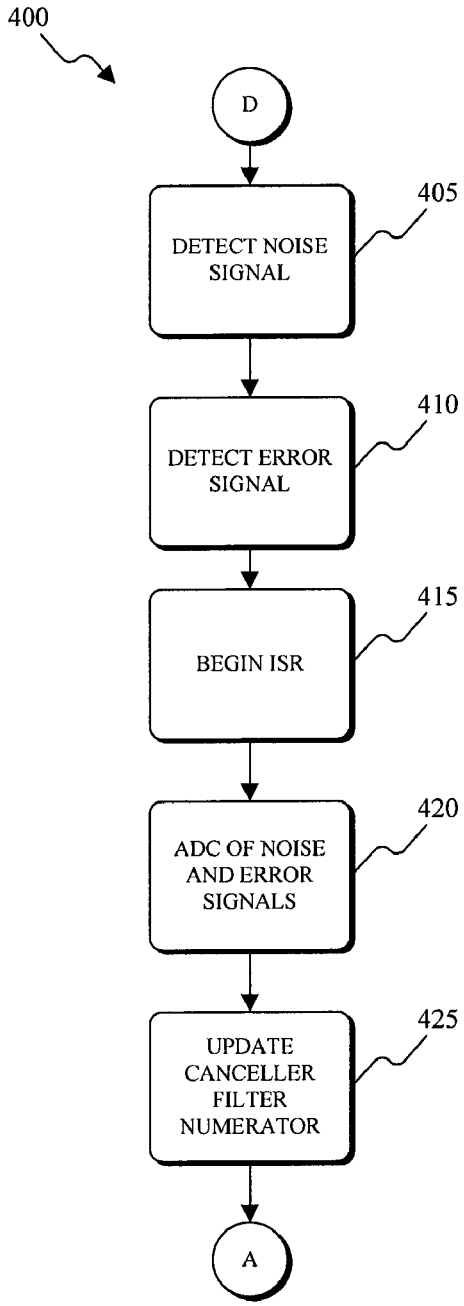
FIGS. 7-10 illustrate a noise cancellation process according to an embodiment of the invention.
Figure 8:
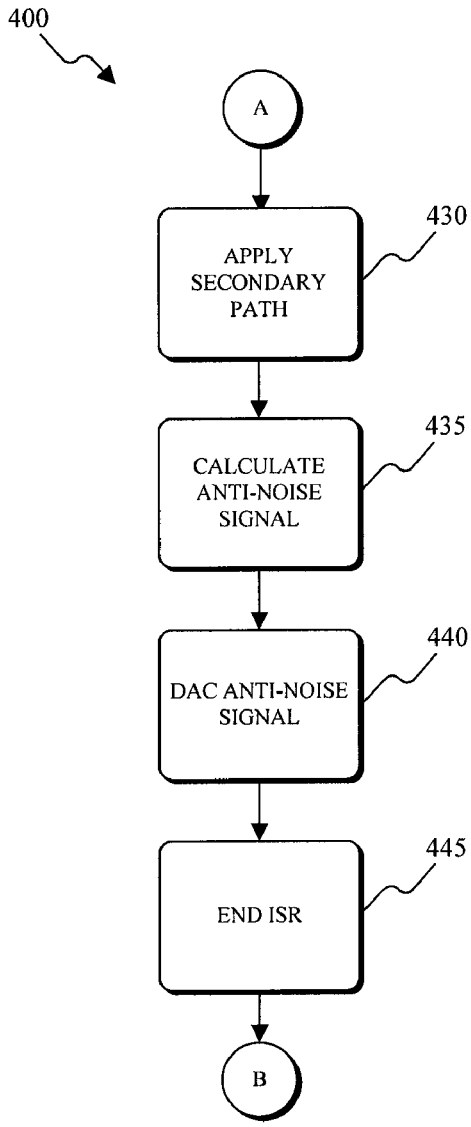
Figure 9:
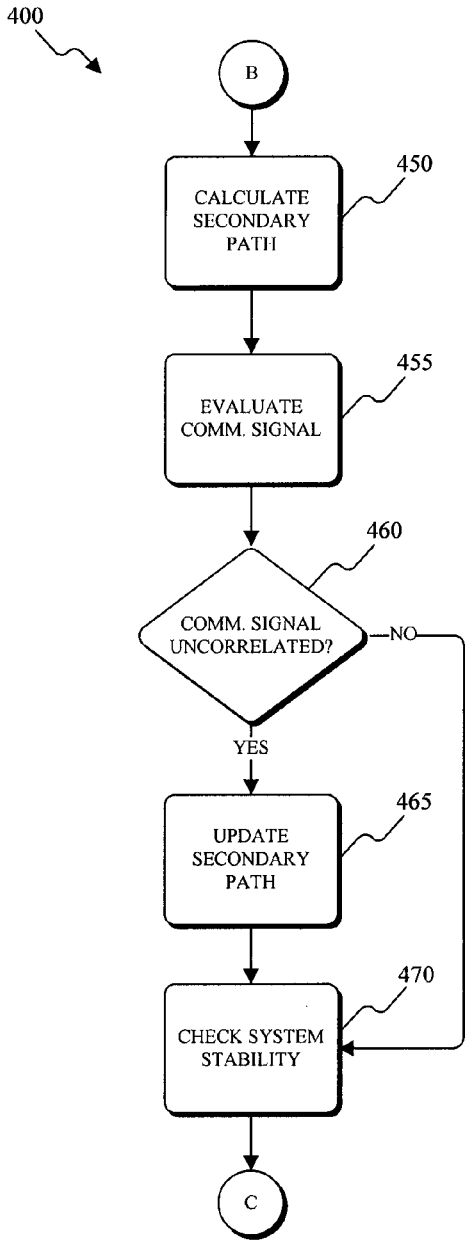
Figure 10:
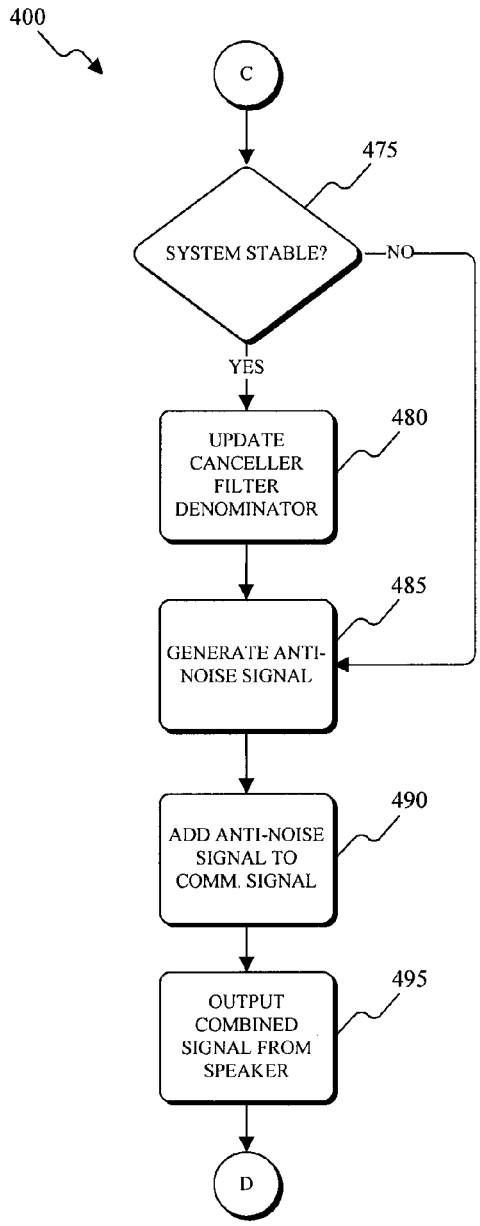

Timing is important when implementing the noise cancellation system 100 digitally. The conversion of the FIR-filter-based plant model to the IIR-filter-based plant model reduces the latency of the noise cancellation system 100. In some embodiments, the generation of an anti-noise signal using the IIR-filter-based plant model is approximately ten times faster than generating the anti-noise signal using an FIR-filter-based plant model. A timing diagram 300 corresponding to the noise cancellation system 100 is illustrated in FIG. 6. In the illustrated timing diagram 300, the generation of an anti-noise signal must be completed in less than 30 μs for the anti-noise signal to properly cancel the noise signal. A first thread 305 represents the majority of the processing requirements for the system 100. The first thread 305 is generally divided into first and second sections 310 and 315. The first section 310, which includes first, second, third, fourth, and fifth partitions 320-340, corresponds to an interrupt service routine ("ISR"). The second section 315, which includes a sixth partition 345 of the first thread 305, separates consecutive ISRs. The signals from the reference and error microphones 105 and 125 are analog-to-digital converted in the first partition 320. For example, at 24 Mhz, the analog-to-digital conversion requires approximately 1 μs. In the second partition 325, the outputs of the ADC 130 are transferred through a serial peripheral interface ("SPI") to the canceller filter module 145, the secondary path module 135, and the adaptation controller module 140. The transfer requires approximately 1 μs. Following transfer through the SPI and in the third partition 330, the adaptation controller module 140 and the canceller filter module 145 are used to calculate an updated numerator of the canceller filter transfer function, apply the secondary path, and calculate the anti-noise signal. The calculations are executed by the controller 110 and require approximately 20 μs. In the fourth partition 335, the output of the canceller filter module 145 is transferred through an external memory interface ("EMIF"), which requires approximately 0.5 μs. In the fifth partition 340, the output of the canceller filter is digital-to-analog converted in the DAC 150, which requires approximately 0.5 μs. The first through fifth partitions 320-340 require approximately 23 μs to execute.

The sixth partition 345 uses the processing time remaining in the first thread. The sixth partition 345 is used to execute first, second, third, and fourth background threads in a decimated matter. For example, the first background thread calculates the secondary path (e.g., in the secondary path module 135) as described above. In the second background thread, the communication signal is evaluated for correlation to identify the quality of the secondary path identified in the first background thread. The third background thread determines the stability of the noise cancellation system 100 using the Schur-Cohn stability criteria as described above. The fourth background thread is used to execute additional control or system functions. In some embodiments, each of the first, second, third, and fourth background threads are executed during the sixth partition 345 of the first thread 305. In other embodiments, a single of the background threads is executed during the sixth partition 345, or as many of the background threads are executed as possible in the remaining time of the first thread 305. The amount of processing performed during a single 30 μs thread is dependent upon, for example, the speed of the controller 110. As processors become faster and more efficient, the first thread 305 can be executed in less than 30 μs, and additional background threads may be added. Thus, the thickness of the ear cup can be made smaller and the latency requirements of the noise cancellation system are shorter. In some embodiments, the processing and generation of the anti-noise signal is performed in approximately 10-40 μs.

A process 400 for implementing the above described noise cancellation system, and corresponding to the timing diagram 300, is illustrated in FIGS. 7-10. The process 400 begins with the detection of a noise signal (step 405) and the detection of an error signal (step 410). Following step 410, the ISR begins (step 415) and the detected noise and error signals are analog-to-digital converted in the ADC 130 (step 420). After step 420, the numerator of the canceller filter is updated (step 425), the secondary path is applied to the canceller filter (step 430), and the anti-noise signal is calculated (step 435). After the anti-noise signal has been calculated at step 435, the anti-noise signal is digital-to-analog converted in the DAC 150 (step 440), and the ISR ends (step 445).

The execution of the background threads is illustrated in steps 450-480 in process 400. With reference to control section B of the process 400 illustrated in FIG. 9, the secondary path is calculated (step 450) using the communication signal as described above. The communication signal is then evaluated (step 455) to determine whether it is a correlated or uncorrelated signal (step 460). If the communication signal is uncorrelated and approximates a white noise signal, the secondary path is updated (step 465). If at step 460, the communication signal is determined to be highly correlated, the controller 110 checks the stability of the system using the Schur-Cohn stability test (step 470). The process 400 then proceeds to control section C shown in and described with respect to FIG. 10. In some embodiments, correlation is determined based on a comparison between the communication signal and a white noise signal. If a correlation coefficient between the communication signal and the white noise signal is greater than a threshold value, the communication signal is considered to be approximately a white noise signal.

At step 475, the controller determines whether the system 100 is stable. If the system 100 is stable, the denominator of the canceller filter transfer function in the canceller filter module 145 can be updated (step 480), and the anti-noise signal is generated (step 485). If the system 100 is not stable, the denominator is not updated, and the anti-noise signal is generated (step 485). The generated anti-noise signal is added to the communication signal (step 490), and the combined output of the communication signal and the anti-noise signal is output from the speaker 120 (step 495). The process 400 then returns to step 405 and control section D shown in and previously described with respect to FIG. 7.

Although the illustrated embodiment of the process 400 shows the generation of an anti-noise signal as a discrete step in a detailed process, the anti-noise signal is capable of being continuously or nearly continuously generated during the operation of the noise cancellation system. Additionally, the process 400 is capable of continuous or nearly continuous execution by the controller 110 to ensure optimal noise cancellation, and various of the described steps can be executed in parallel.

Also, the background threads are shown and described in a continuous manner in steps 450-480 of the process 400 for descriptive purposes. As previously described, the background threads are executed in a decimated manner and not every background thread is necessarily executed following a single ISR. In some embodiments, an iterative approach is used in which a single of the background threads is executed following an ISR. For example, steps 450-465 are executed following a first ISR, and steps 470-480 are executed following a second ISR.

Figure 11:
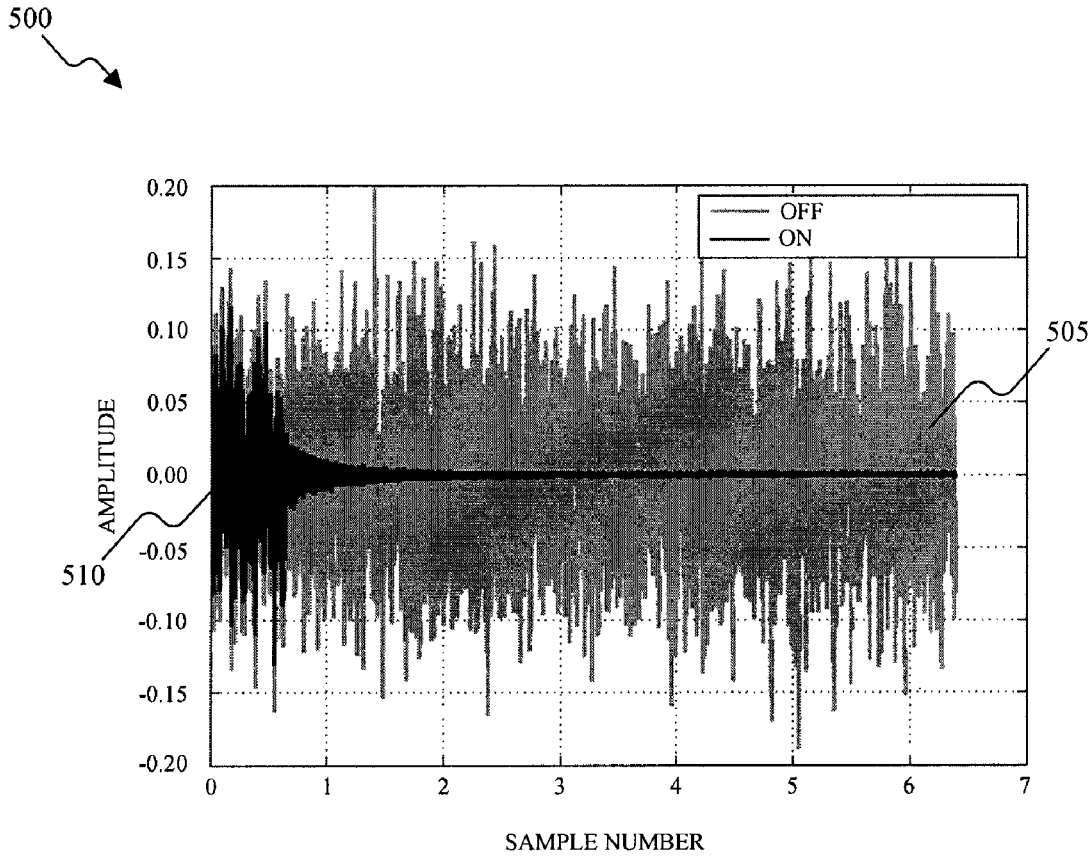
FIG. 11 illustrates the effect of the noise cancellation system of FIG. 3.

FIG. 11 illustrates a diagram 500 showing the effectiveness of the above described noise cancellation system and method. A first signal 505 is a white noise signal sensed by the error microphone 125 when the noise cancellation system is inactive. A second signal 510 is the signal sensed by the error microphone 125 when the above-described noise cancellation system is active.

Thus, the invention provides, among other things, an adaptive feed-forward noise cancellation system and method that is implemented using a digital signal processor. Various features and advantages of the invention are set forth in the following claims.

What is claimed is:

1. An adaptive noise cancellation system for a headset, the noise cancellation system comprising:

a plurality of reference microphones configured to detect a noise signal;

an error microphone configured to detect an acoustic error signal;

a controller connected to the plurality of reference microphones and the error microphone, the controller configured to control adaptation of an infinite impulse response ("IIR") canceller filter based at least in part on a stability determination for the noise cancellation system and a secondary path model, control updating of the secondary path model, generate an anti-noise signal based on the IIR canceller filter, and output the anti-noise signal;

wherein the IIR canceller filter is generated by converting a finite impulse response ("FIR") canceller filter using a balanced model reduction technique;

wherein the anti-noise signal is electrically combined with an audio signal to generate a combined signal, and the combined signal is provided to a speaker; and wherein the secondary path model is updated when a communication signal approximates a white noise signal and the communication signal is larger than a threshold value.

2. The system of claim 1, wherein a denominator of an IIR canceller filter transfer function is updated when system stability has been confirmed.

3. The system of claim 2, wherein stability is determined using Schur-Cohn stability criteria.

4. The system of claim 1, wherein the anti-noise signal is generated within approximately sixty micro-seconds of detecting the noise signal.

5. The system of claim 1, wherein the plurality of reference microphones includes three or more reference microphones.

6. The system of claim 5, wherein each of the three or more reference microphones detects the noise signal, and the noise signal is used to update the IIR canceller filter.

7. A method of implementing adaptive noise cancellation in a system which includes a plurality of reference microphones and an error microphone, the method comprising:

detecting one or more noise signals using the plurality of reference microphones;

detecting an acoustic error signal using the error microphone;

identifying a secondary path model in an on-line manner where the secondary path model is updated when a communication signal approximates a white noise signal and the communication signal is larger than a threshold value;

determining a stability of the system;

controlling adaptation of an infinite impulse response ("IIR") canceller filter based at least in part on the stability determination and the identified secondary path model, wherein the IIR canceller filter is generated by converting a finite impulse response ("FIR") canceller filter using a balanced model reduction technique;

generating an anti-noise signal based on the canceller filter; and electrically combining the anti-noise signal with an audio signal to generate a combined signal.

8. The method of claim 7, wherein a denominator of an IIR canceller filter transfer function is updated when the stability of the system has been confirmed.

9. The method of claim 8, wherein stability is determined using Schur-Cohn stability criteria.

10. The method of claim 7, wherein the anti-noise signal is generated within approximately sixty micro-seconds of detecting the one or more noise signals.

11. The method of claim 7, wherein the plurality of reference microphones includes three or more reference microphones.

12. The method of claim 11, further comprising detecting a noise signal at each of the three or more reference microphones; and updating the IIR canceller filter based on the noise signal detected by at least one of the three or more reference microphones.

13. A controller configured to generate an anti-noise signal, the controller comprising:

a memory module;

a processing unit configured to receive a reference signal related to a first acoustic signal detected by a reference microphone;

receive an error signal related to a second acoustic signal detected by an error microphone;

identify a secondary path model in an on-line manner, where the secondary path model is updated when a communication signal approximates a white noise signal and the communication signal is larger than a threshold value;

determine a stability of the system;

control adaptation of an infinite impulse response ("IIR") canceller filter based at least in part on the stability determination and the identified secondary path model, wherein the IIR canceller filter is generated by converting a finite impulse response ("FIR") canceller filter using a balanced model reduction technique; and generate the anti-noise signal based on the canceller filter.

14. The controller of claim 13, wherein a denominator of an IIR canceller filter transfer function is updated when the stability of the system has been confirmed.

15. The method of claim 13, wherein the secondary path model is updated when a communication signal approximates a white noise signal.

16. The method of claim 13, wherein the anti-noise signal is generated within approximately sixty micro-seconds of detecting the reference signal.

17. The method of claim 13, wherein the anti-noise signal is generated within approximately forty micro-seconds of detecting the reference signal.

18. The method of claim 13, wherein the anti-noise signal is generated in between approximately ten and approximately forty micro-seconds of detecting the reference signal.

* * * * *